US008357642B2

(12) United States Patent
Maeda et al.

(10) Patent No.: US 8,357,642 B2
(45) Date of Patent: Jan. 22, 2013

(54) FUNCTIONAL FLUID

(75) Inventors: Akio Maeda, Yamaguchi (JP); Satoshi Yamamoto, Yamaguchi (JP)

(73) Assignee: Chiyoda Chemical Co., Ltd., Yamaguchi (JP)

( * ) Notice: Subject to any disclaimer, the term of this patent is extended or adjusted under 35 U.S.C. 154(b) by 122 days.

(21) Appl. No.: 12/451,642

(22) PCT Filed: May 24, 2007

(86) PCT No.: PCT/JP2007/060619

§ 371 (c)(1),
(2), (4) Date: Nov. 23, 2009

(87) PCT Pub. No.: WO2008/142795

PCT Pub. Date: Nov. 27, 2008

(65) Prior Publication Data

US 2010/0137174 A1 Jun. 3, 2010

(51) Int. Cl.
*C10M 135/32* (2006.01)
*C10M 133/44* (2006.01)

(52) U.S. Cl. ..... 508/279; 508/269

(58) Field of Classification Search ..... 508/269, 508/279

See application file for complete search history.

(56) References Cited

U.S. PATENT DOCUMENTS

| | | | | |
|---|---|---|---|---|
| 4,285,823 | A * | 8/1981 | Sung et al. | 508/279 |
| 4,392,968 | A * | 7/1983 | Ishida et al. | 508/261 |
| 5,171,462 | A * | 12/1992 | DeRosa et al. | 508/281 |
| 5,744,069 | A * | 4/1998 | Maeda et al. | 252/394 |
| 5,773,393 | A * | 6/1998 | Adams | 508/551 |
| 6,074,992 | A | 6/2000 | Levesque | |
| 2003/0065116 | A1 * | 4/2003 | Ghosh et al. | 526/258 |
| 2003/0141482 | A1 | 7/2003 | Wenderoth et al. | |

FOREIGN PATENT DOCUMENTS

| | | |
|---|---|---|
| DE | 42 18 585 | 9/1993 |
| JP | 57-36193 | 2/1982 |
| JP | 59-157188 | 10/1984 |
| JP | 07-145491 | 6/1995 |
| JP | 08-325587 | 12/1996 |
| JP | 2002-536494 | 10/2002 |
| JP | 2003-171685 | 6/2003 |

OTHER PUBLICATIONS

International Search Report issued Jul. 10, 2007 in International (PCT) Application No. PCT/JP2007/060619.

Supplementary European Search Report, issued Jul. 13, 2011 in counterpart European Application No. 07 74 4053.

Li et al., "The Tribological Study of a Tetrazole Derivative as Additive in Liquid Paraffin", *Wear*, vol. 246, 2000, pp. 130-133.

Ren et al., "The Effect of Several Tetrazole Derivatives as Additives on the Extreme-pressure and Antiwear Properties of Liquid Paraffin and a Lithium Grease", *Tribology*, vol. 20, No. 6, Dec. 2000, pp. 451-454, with English language abstract.

Ho et al., "The Tribochemical Study of Some N-containing Heterocyclic Compounds as Lubricating Oil Additives", *Tribology Letters*, vol. 13, No. 2, Aug. 2002, pp. 87-93.

* cited by examiner

*Primary Examiner* — Walter D Griffin
*Assistant Examiner* — Francis C Campanell
(74) *Attorney, Agent, or Firm* — Wenderoth, Lind & Ponack, L.L.P.

(57) ABSTRACT

Provided is a functional fluid including a tetrazole compound (A) and a base oil (B), which may further include a triazole compound (C).

3 Claims, No Drawings

FUNCTIONAL FLUID

TECHNICAL FIELD

The present invention relates to a functional fluid which is useful for various purposes such as acting as a brake fluid, an operating fluid, an engine coolant fluid, a transmission fluid, a lubricant, and a fluid for metal working. More specifically, the present invention relates to a functional fluid which is excellent in resistance to corrosion and to sediment formation.

BACKGROUND ART

When a functional fluid is used in applications such as brake fluids or the like, the functional fluid faces problems of corrosion, oxidation, sediment formation, and the like. This is because in many cases, the functional fluid is exposed to a metal surface typically containing copper, zinc, aluminum, and brass and also to a rubber part under extreme conditions such as high temperature. Higher under the hood temperatures in modern cars and trucks, an anti-lock brake system, and longer driving times have created a demand for high-performance functional fluids with better resistance to corrosion, sediment formation and degradation over long periods of use.

A functional fluid typically includes: a base oil formed of a glycol, a glycol ether, esters including, a borate ester and a phosphate ester, an ethoxylated alcohol or a propoxylated alcohol, a hydrocarbon, and the like to which various additives are added to impart resistance to corrosion of various metals, sediment formation, and degradation. In a functional fluid containing triazole compounds, it is known that various compounds are useful as antioxidants, corrosion inhibitors, and the like.

For example, Patent Document 1 discloses an ester composition formed with a major proportion of an ester or a mixture of esters and 0.002 to 2 wt % of amino-substituted 1,2,4-triazole having a specific structure.

Further, Patent Document 2 discloses a functional fluid including a mixture of (a) benzotriazole, a derivative thereof, or a mixture thereof and (b) 1,2,4-triazole, a derivative thereof, or a mixture thereof in an amount effective for suppressing corrosion as well as a base fluid containing at least one kind of compound selected from the group consisting of a glycol, a glycol ether, an ester, and a hydrocarbon (Claim 1).

Further, Patent Document 3 discloses a brake fluid composition in which, to a base fluid for the brake fluid, 0.01 wt % or more of one or more kinds selected from benzotriazoles and derivatives thereof and 0.05 wt % or more of one or more kinds of thiadiazole derivatives each having a specific structure are added.

Further, Patent Document 4 discloses: a hydraulic fluid containing a specific heterocyclic compound for improved corrosion resistance for non-ferrous metals, (Claim 1); and a brake fluid for motor vehicles which contains, as an additional corrosion inhibitor, benzimidazole, tolutriazole, benzotriazole, and/or hydrogenated tolutriazole, together with a heterocyclic compound (Claim 7).

In addition, Patent Document 5 discloses a hydraulic fluid with improved anti-corrosion properties containing (a) 0.05 to 0.0125 mass % of 1H-1,2,4-triazole and (b) 0 to 10 mass % of one or more kinds of other corrosion inhibitors, whereby with the co-use of 1H-1,2,3-benzotriazole and/or 1H-1,2,3-tolytriazole and/or derivatives thereof, the mass ratio of 1H-1,2,4-triazole to the above-mentioned 1H-1,2,3-triazole compounds must be greater than 4:1 (Claim 1).

Patent Document 1: GB 1,111,680
Patent Document 2: JP 2002-536494 A
Patent Document 3: JP 59-157188 A
Patent Document 4: JP 2003-534445 A
Patent Document 5: JP 2004-523641 A

DISCLOSURE OF THE INVENTION

Problem to be Solved by the Invention

Even though, in the ester composition disclosed in Patent Document 1, the amino-substituted triazole has good corrosion resistance in some metals, the ester composition does not improve resistance to copper corrosion and sediment formation. Further, in Patent Documents 2, 4, and 5, although 1H-1,2,4-triazole is blended to each of the fluids, copper corrosion cannot be suppressed by the use of 1H-1,2,4-triazole alone. In addition, the brake fluid composition disclosed in Patent Document 3 is effective in decreasing sediment formation and suppressing copper corrosion, but on the other hand, a sulfur-containing compound such as a thiadiazole derivative, which may have an adverse effect on long-term thermal stability of the brake fluid composition, is used in its composition.

Accordingly, an object of the present invention is to provide a functional fluid excellent in suppression of metal corrosion and sediment formation.

Means for Solving the Problem

The inventors of the present invention have intensively studied in order to solve the above problem, and as a result, the inventors have found that the amount of sediment formed in the functional fluid is decreased and metal corrosion resistance is improved by adding a tetrazole compound to a base oil. Thus, the present invention has been achieved.

That is, the present invention relates to a functional fluid including: a tetrazole compound (A); and a base oil (B).

The functional fluid of the present invention further includes a triazole compound (C).

Further, the functional fluid of the present invention includes one or more kinds of other additives selected from the group consisting of amines, antioxidants, chelating agents, viscosity index improving agents, extreme pressure agents, defoaming agents, and colorants.

Effects of the Invention

The functional fluid of the present invention has the effects of exhibiting improved resistance to corrosion, sediment formation, and degradation over long periods of use in the case of being exposed to metal surfaces containing, in particular, copper and rubber parts under extreme conditions such as high temperatures.

BEST MODE FOR CARRYING OUT THE INVENTION

A functional fluid of the present invention is composed of a tetrazole compound (A) and a base oil (B).

As the tetrazole compound (A) to be used in the functional fluid of the present invention, preferred are compounds in which the 1- and 5-positions of a tetrazole such as 1H-tetrazole or 2H-tetrazole may each be hydrogen or saturated or unsaturated substituents having 1 to 12 carbon atoms, may be linear or branched, may include a cyclic structure (alicyclic or aromatic ring), and may include oxygen (hydroxyl group, carbonyl group, carboxyl group, ether, ester, or the like), nitrogen (amino group, amide group, nitro group, cyano group, or the like), sulfur (thiol group, sulfide, or the like), or a halogen (fluorine, chlorine, bromine, iodine, or the like).

Examples of tetrazoles include 1H-tetrazole, 5-amino-1H-tetrazole, 5-methyl-1H-tetrazole, 1-methyl-5-ethyl-1H-tetrazole, 1-methyl-5-aminotetrazole, 1-methyl-5-mercapto-1H-tetrazole, 1-phenyl-5-mercapto-1H-tetrazole, 1-(2-dimethylaminoethyl)-5-mercapto-1H-tetrazole, 5-phenyl-1H-tetrazole, 5,5'-bis-1H-tetrazole diammonium salt, 4,5-di(5-tetrazolyl)-[1,2,3]triazole, and 5,5'-azobis-1H-tetrazole. It should be noted that, of these compounds, 1H-tetrazole, 5-methyl-1H-tetrazole, 5-amino-1H-tetrazole, 5-phenyl-1H-tetrazole, and 5,5'-azobis-1H-tetrazole are particularly preferred.

Examples of the base oil (B) which may be selected include: glycols such as ethylene glycol, diethylene glycol, triethylene glycol, polyethylene glycol, and propylene glycol, as well as polymeric derivatives, and mixtures thereof; glycol ethers such as methyl, ethyl, propyl, butyl, or hexyl di-, tri-, and tetraglycol ethers, including ethyl diglycol ether, butyl diglycol ether, methoxytriglycol, ethoxytriglycol, butoxytriglycol, methoxytetraglycol, and butoxytetraglycol, diethylene glycol monomethyl ether, triethylene glycol monomethyl ether, diethylene glycol monoethyl ether, triethylene glycol monoethyl ether, diethylene glycol monobutyl ether, triethylene glycol monobutyl ether, tetraethylene glycol monomethyl ether, polyethylene glycol monoalkyl ether, dipropylene glycol monomethyl ether, and polypropylene glycol monoalkyl ether; and esters including borate esters such as, but not limited to, triethylene glycol monomethyl ether borate ester or tetraethylene glycol monomethyl ether borate ester and phosphate esters such as tricresyl phosphate ester, triphenyl phosphate ester, substituted phenol phosphate ester, or alkyl phosphate esters. In addition, mixtures of glycols with glycol ethers and/or borate esters or phosphate esters may be used if desired. When the functional fluid is used as a lubricant, a transmission fluid, and the like, the base oil may be a hydrocarbon. It should be noted that, of these base oils, diethylene glycol monoethyl ether, triethylene glycol monomethyl ether, triethylene glycol monobutyl ether, and tetraethylene glycol monomethyl ether, and the like are particularly preferred.

Here, the blending amount of the tetrazole compound (A) is in a range of 0.005 mass % to 0.5 mass % and preferably in a range of 0.01 to 0.1 mass % with respect to the total mass of the functional fluid. It should be noted that when the blending amount of the tetrazole compound (A) is less than 0.005 mass, it is not preferred because sufficient prevention of metal corrosion and suppression of sediment formation cannot be obtained, and when the blending amount exceeds 0.5 mass %, it is not preferred because sufficient prevention of metal corrosion cannot be obtained.

Further, a triazole compound (C) may be blended to the functional fluid of the present invention. When the triazole compound (C) is blended to the tetrazole compound (A) and the base oil (B), it has the effects of further enhancing the prevention of copper corrosion and suppression of sediment formation, exhibited by the tetrazole compound (A).

Here, the triazole compound (C) which can be blended to the functional fluid of the present invention includes a triazole compound such as 1H-1,2,3-triazole, 2H-1,2,3-triazole, 1H-1,2,4-triazole, or 4H-1,2,4-triazole, or a compound having a condensed structure such as a benzene or naphthalene ring. Here, preferred is a compound in which nitrogen in a triazole ring and/or a aromatic ring may include a substituent, the substituent having 1 to 12 carbon atoms being saturated or unsaturated, linear or branched or having a cyclic structure (alicyclic and aromatic ring) and possibly containing oxygen (hydroxyl group, carbonyl group, carboxyl group, ether, ester, or the like), nitrogen (amino group, amide group, nitro group, cyano group, or the like), sulfur (thiol group, sulfide, or the like), or a halogen (fluorine, chlorine, bromine, iodine, or the like).

Examples of the triazole compound include 1-(1',2'-di-carboxyethyl)benzotriazole, 2-(2'-hydroxy-5'-methylphenyl)benzotriazole, 1H-1,2,3-triazole, 2H-1,2,3-triazole, 1H-1,2,4-triazole, 4H-1,2,4-triazole, benzotriazole, tolyltriazole, carboxybenzotriazole, 3-amino-1,2,4-triazole, chlorobenzotriazole, nitrobenzotriazole, aminobenzotriazole, cyclohexano[1,2-d]triazole, 4,5,6,7-tetrahydroxytolyltriazole, 1-hydroxybenzotriazole, ethylbenzotriazole, naphthotriazole, 1-[N,N-bis(2-ethylhexyl)aminomethyl]benzotriazole, 1-[N,N-bis(2-ethylhexyl)aminomethyl]tolyltriazole, 1-[N,N-bis(2-ethylhexyl)aminomethyl]carboxybenzotriazole, 1-[N,N-bis(di-(ethanol)-aminomethyl]benzotriazole, 1-[N,N-bis(di-(ethanol)-aminomethyl]tolyltriazole, 1-[N,N-bis(di-(ethanol)-aminomethyl]carboxybenzotriazole, 1-[N,N-bis(2-hydroxypropyl)aminomethyl]carboxybenzotriazole, 1-[N,N-bis(1-butyl)aminomethyl]carboxybenzotriazole, 1-[N,N-bis(1-octyl)aminomethyl]carboxybenzotriazole, 1-(2',3'-di-hydroxypropyl)benzotriazole, 1-(2',3'-di-carboxyethyl)benzotriazole, 2-(2'-hydroxy-3',5'-di-tert-butylphenyl)benzotriazole, 2-(2'-hydroxy-3',5'-di-tert-amylphenyl)benzotriazole, 2-(2'-hydroxy-4'-octoxyphenyl)benzotriazole, 2-(2'-hydroxy-5'-tert-butylphenyl)benzotriazole, 1-hydroxybenzotriazole-6-carboxylic acid, 1-oleoylbenzotriazole, 1,2,4-triazole-3-ol, 3-amino-5-phenyl-1,2,4-triazole, 3-amino-5-heptyl-1,2,4-triazole, 3-amino-5-(4-isopropyl-phenyl)-1,2,4-triazole, 5-amino-3-mercapto-1,2,4-triazole, 3-amino-5-(p.tert-butylphenyl)-1,2,4-triazole, 5-amino-1,2,4-triazole-3-carboxylic acid, 1,2,4-triazole-3-carboxyamide, 4-aminourazole, and 1,2,4-triazole-5-one. It should be noted that, of those compounds, 1-(1',2'-di-carboxyethyl)benzotriazole, 1,2,4-triazole-3-ol, 1,2,4-triazole-3-carboxyamide, 4-aminourazole, 1,2,4-triazole-5-one, 1H-1,2,4-triazole, benzotriazole, tolyltriazole, carboxybenzotriazole, 3-amino-1,2,4-triazole, cyclohexano[1,2-d]triazole, 1-[N,N-bis(2-ethylhexyl)aminomethyl]benzotriazole, 1-[N,N-bis(2-ethylhexyl)aminomethyl]tolyltriazole, 1-[N,N-bis(2-ethylhexyl)aminomethyl]carboxybenzotriazole, and 5-amino-1,2,4-triazole-3-carboxylic acid are particularly preferred.

The blending amount of the triazole compound (C) is in a range of 0.005 mass % to 0.5 mass % and preferably in a range of 0.01 to 0.1 mass % with respect to the total mass of the functional fluid. It should be noted that when the blending amount of the triazole compound (C) is less than 0.005 mass %, it is not preferred because sufficient prevention of metal corrosion and suppression of sediment formation cannot be obtained, and when the blending amount exceeds 0.5 mass %, it is not preferred because a sufficient prevention of metal corrosion cannot be obtained.

In addition, if necessary, other known additives such as amines (anti-corrosion agent), an antioxidant, a chelating agent, a viscosity index improving agent, an extreme pressure agent, a defoaming agent, and a colorant can be further added to the functional fluid of the present invention. These additives may be used alone or in combination of two or more kinds.

Examples of the amines (anti-corrosion agent) include ammonia, ethylenediamine, triethylenetetramine, monoethanolamine, diethanolamine, triethanolamine, monoisopropanolamine, diisopropanolamine, triisopropanolamine, diethylenetriamine, diethylamine, dibutylamine, hexahydroaniline, tetraethylene pentamine, pentaethylene hexamine, allylamine, 2-aminopropanol, 3-aminopropanol, 4-aminobutanol, 4-methylaminobutanol, ethylaminoethylamine, 2-ethylhexylamine, di-2-ethylhexylamine, oleylamine, dodecylamine, dicyclohexylamine, octylamine, octadecylamine, and hexylamine. One of these kinds may be used alone or two or more of these kinds may be used in combination. It should be noted that, of these compounds, dibutylamine, dicyclohexylamine, and di-2-ethylhexylamine are particularly preferred.

Examples of the antioxidant include dibutylhydroxy tolulene, butylhydroxy anisole, 2,4-dimethyl-6-tert-butylphenol, 4,4-butylidenebis(6-tert-butylmetacresol), 2,6-di-tert-butylparacresol, para-tert-butylcresol, 4,4'-methylenebis(2,6-di-tert-butylphenol), 4,4'-bis(2,6-di-tert-butylphenol), 4,4'-bis(2-methyl-6-tert-butylphenol), 2,2'-methylenebis(4-ethyl-6-tert-butylphenol), 2,2'-methylenebis(4-methyl-6-tert-butylphenol), 4,4'-butylidenebis(3-methyl-6-tert-butylphenol), 4,4'-isopropylidenebis(2,6-di-tert-butylphenol), 2,2'-methylenebis(4-methyl-6-nonylphenol), 2,2'-isobutylidenebis(4,6-dimethylphenol), 2,2'-methylenebis(4-methyl-6-cyclohexylphenol), 2,6-di-tert-butyl-4-ethylphenol, 2,4-dimethyl-6-tert-butylphenol, 2,6-di-tert-α-dimethylamino-p-cresol, 2,6-di-tert-butyl-4(N,N'-dimethylaminomethylphenol), 4,4'-thiobis(2-methyl-6-tert-butylphenol), 4,4'-thiobis(3-methyl-6-tert-butylphenol), 2,2'-thiobis(4-methyl-6-tert-butylphenol), bis(3-methyl-4-hydroxy-5-tert-butylbenzyl)sulfide, bis(3,5-di-tert-butyl-4-hydroxybenzyl)sulfide, 2,2'-thio-diethylenebis[3-(3,5-di-tert-butyl-4-hydroxyphenyl) propionate], tridecyl-3-(3,5-di-tert-butyl-4-hydroxyphenyl) propionate, pentaerythrityl-tetrakis[3-(3,5-di-tert-butyl-4-hydroxyphenyl)propionate], octyl-3-(3,5-di-tert-butyl-4-hydroxyphenyl)propionate, octadecyl-3-(3,5-di-tert-butyl-4-hydroxyphenyl)propionate, octyl-3-(3-methyl-5-tert-butyl-4-hydroxyphenyl)propionate, 2,2'-methylenebis[6-(1-methylcyclohexyl)-p-cresol], 2,2'-ethylidenebis(4,6-di-tert-butylphenol), 2,2'-butylidenebis(2-tert-butyl-4-methylphenol), 1,1,3-tris(2-methyl-4-hydroxy-5-tert-butylphenyl)butane, triethylene glycol-bis[3-(3-tert-butyl-5-methyl-4-hydroxyphenyl)propionate], 1,6-hexanediol-bis[3-(3,5-di-tert-butyl-4-hydroxyphenyl) propionate], 2,2'-thiodiethylenebis[3-(3,5-di-tert-butyl-4-hydroxyphenyl) propionate], 2,6-dicyclohexyl-4-methylphenol, 2,6-diisopropyl-4-ethylphenol, 2,6-di-tert-amyl-4-methylphenol, 2,6-di-tert-octyl-4-n-propylphenol, 2,6-dicyclohexyl-4-n-octylphenol, 2-isopropyl-4-methyl-6-tert-butylphenol, 2-tert-butyl-2-ethyl-6-tert-octylphenol, 2-isobutyl-4-ethyl-5-tert-hexylphenol, 2-cyclohexyl-4-n-butyl-6-isopropylphenol, styrenated mixed cresol, d1-α-tocophenol, tert-butylhydroquinone, N,N'-hexamethylenebis(3,5-di-tert-butyl-4-hydroxy-hydrocinnamide), 3,5-di-tert-butyl-4-hydroxybenzylphosphonate-diethyl ester, 1,3,5-tris(2,6-dimethyl-3-hydroxy-4-tert-butylbenzyl)isocyanurate, 1,3,5-tris[(3,5-di-tert-butyl-4-hydroxyphenyl)propionyloxyethyl]isocyanurate, tris(4-tert-butyl-2,6-dimethyl-3-hydroxybenzyl)isocyanurate, 2,4-bis(n-octylthio)-6-(4-hydroxy-3,5-di-tert-butylanilino)-1,3,5-triazine, tetrakis[methylene-3-(3,5-di-tert-butyl-4-hydroxyphenyl) propionate]methane, bis(3,5-di-tert-butyl-4-hydroxybenzylethyl phosphonate)calcium, N,N'-bis[3-(3,5-di-tert-butyl-4-hydroxyphenyl)propionyl]hydrazine, 2,2'-oxamidebis[ethyl-3-(3,5-di-tert-butyl-4-hydroxyphenyl) propionate], bis[2-tert-butyl-4-methyl-6-(3-tert-butyl-5-methyl-2-hydroxybenzyl)phenyl]terephthalate, 1,3,5-trimethyl-2,4,6-tris(3,5-di-tert-butyl-4-hydroxybenzyl) benzene, 3,9-bis[1,1-dimethyl-2-[β-(3-tert-butyl-4-hydroxy-5-methylphenyl)propionyloxy]ethyl]-2,4,8,10-tetraoxaspiro[5,5]undecane, 2,2-bis[4-[2-(3,5-di-tert-butyl-4-hydroxyhydrocinnamoyloxy)]ethoxyphenyl]propane, and a β-(3,5-di-tert-butyl-4-hydroxyphenyl)propionic acid alkyl ester such as stearyl-β-(4-hydroxy-3,5-di-tert-butylphenol) propionate; phenyl-α-naphthylamine, alkylphenyl-α-naphthylamine, p,p'-dioctyldiphenylamine, 3,7-dioctylphenothiazine, di(alkylphenyl)amine (the alkyl group having 4 to 20 carbon atoms), alkyldiphenylamine (the alkyl group having 4 to 20 carbon atoms), N-nitrosodiphenylamine, phenothiazine, N,N'-dinaphthy-p-phenylenediamine, acridine, N-methylphenothiazine, N-ethylphenothiazine, dibyldylamine, diphenylamine, phenolamine, 2,6-di-tert-butyl-α-dimethylaminoparacresol, 2,2,6,6-tetramethyl-4-piperidyl benzoate, bis-(1,2,6,6-pentamethyl-4-piperidyl)-2-(3,5-di-tert-butyl-4-hydroxybenzyl)-2-n-butylmalonate, bis(2,2,6,6-tetramethyl-4-piperidyl)sepacate, succinic acid dimethyl-1-(2-hydroxyethyl)-4-hydroxy-2,2,6,6-tetramethylpiperizine polycondensate, poly[6-(1,1,3,3-tetramethylbutyl)imino-1,3,5-triazine-2,4-diyl][(2,2,6,6-tetramethyl-4-piperidyl) imino]hexamethylene[2,2,6,6-tetramethyl-4-piperidyl] imino], tetrakis(2,2,6,6-tetramethyl-4-piperidyl)-1,2,3,4-butanetetracarboxylate, bis-(N-methyl-2,2,6,6-tetramethyl-4-piperidyl)sepacate, 1,1'-(1,2-ethanediyl)bis(3,3,5,5-tetramethylpiperadinone), (mixed 2,2,6,6-tetramethyl-4-piperidyl/tridecyl)-1,2,3,4-butanetetracarboxylate, (mixed 1,2,2,6,6-pentamethyl-4-piperidyl/tridecyl)-1,2,3,4-butanetetracarboxylate, mixed [2,2,6,6-tetramethyl-4-piperidyl/β,β,β',β'-tetramethyl-3,9-[2,4,8,10-tetraoxaspiro(5,5)undecane]diethyl]-1,2,3,4-butanetetracarboxylate, mixed [1,2,2,6,6-pentamethyl-4-piperidyl/β,β,β',β'-tetramethyl-3,9-[2,4,8,10-tetraoxaspiro(5,5)undecane]diethyl]-1,2,3,4-butanetetracarboxyalte, N,N'-bis(3-aminopropyl) ethylenediamine-2,4-bis[N-butyl-N-(1,2,2,6,6-pentamethyl-4-piperidyl)amino]-6-chloro-1,3,5-triazine condensate, poly[6-N-morpholyl-1,3,5-triazine-2,4-diyl][(2,2,6,6-tetramethyl-4-piperidyl)imino]hexamethylene[(2,2,6,6-tetramethyl-4-piperidyl)imide], a condensate of N,N'-bis(2,2,6,6-tetramethyl-4-piperidyl)hexamethylenediamine and 1,2-dibromoethane; [N-(2,2,6,6-tetramethyl-4-piperidyl)-2-methyl-2-(2,2,6,6-tetramethyl-4-piperidyl)imino]propionamide, diphenylisodecyl phosphite, diphenyltridecyl phosphite, triphenyl phosphite, tris(nonylphenyl)phosphite, tris(2,4-di-tert-butylphenyl)phosphite, tris(butoxyethyl)phosphite, tetramidecyl-4,4'-butylidenebis(3-methyl-6-tert-butylphenol)-diphosphite, trioctylphosphite, trilauryl phosphite, tristridecyl phosphite, trisisodecyl phosphite, phenyldiisooctyl phosphite, phenyldiisodecyl phosphite, phenyldi(tridecyl) phosphite, diphenylisooctyl phosphite, 4,4'-isopropylidenebis(2-tert-butylphenol)/di(nonylphenyl)phosphite, tris(biphenyl)phosphite, tetra(tridecyl)-1,1,3-tris(2-methyl-5-tert-butyl-4-hydroxyphenyl)butane diphosphite, tris(3,5-di-tert-butyl-4-hydroxyphenyl)phosphite, hydrogenated-4,4'-isopropylidene diphenol polyphosphite, bis(octylphenyl)/bis[4,4'-butylidenebis(3-methyl-6-tert-butylphenol)/1,6-hexanediol phosphite, hexamidecyl-1,1,3-tris(2-methyl-4-hydroxy-5-tert-butylphenol)diphosphite, tris[4,4'-isopropylidenebis(2-tert-butylphenol)]phosphite, tris(1,3-distearoyloxyisopropyl)phosphite, 9,10-dihydro-9-phosphaphenanthrene-10-oxide, tetrakis(2,4-di-tert-butylphenyl)-4,4'-biphenylene diphosphonite, distearylpentaerythritol diphosphite, di(nonylphenyl)pentaerythritol diphosphite, phenyl/4,4'-isopropylidenediphenol/pentaerythritol diphosphite, bis(2,4-di-tert-butylphenyl) pentaerythritol diphosphite, bis(2,6-di-tert-butyl-4-methylphenyl)pentaerythritol diphosphite, and phenylbisphenol-A-pentaerythritol diphosphite; dilauryl thiodipropionate, dimyristyl thiodipropionate, distearyl thiodipropionate, glycerinetributyl thiopropionate, glycerinetrioctyl thiopropionate, glycerinetrilauryl thiopropionate, glycerinetristearyl thiopropionate, trimethylolethanetributyl thiopropionate, trimethylolethanetrioctyl thiopropionate, trimethylolethanetrilauryl thiopropionate, trimethylolethanetristearyl thiopropionate, pentaerythritoltetrabutyl thiopropionate, pentaerythritoltetraoctyl thiopropionate, pentaerythritoltetralauryl thiopropionate, and pentaerythritoltetrastearyl thiopropionate. It should be noted that, of those compounds, dibutylhydroxytolulene, butylhydroxyanisole, 4,4-butylidenebis(6-tert-butylmetacresol), and 2,6-di-tert-butylparacresolare are particularly preferred.

Examples of the chelating agent include ethylenediaminetetraacetic acid, 1,2-cyclohexanediaminetetraacetic acid, dihydroxyethyl glycine, diaminopropanoltetraacetic acid, diethylenetriaminepentaacetic acid, ethylenediaminediacetic acid, methyl glycine diacetic acid, ethylenediaminedipropionaic acid, hydroxyethylenediaminetriacetic acid, glycol ether diamine tetraacetaic acid, hexamethylenediaminetetraacetaic acid, ethylenediaminedi(o-hydroxyphenyl)acetic acid, hydroxyethyliminodiacetic acid, iminodiacetic acid, 1,3-diaminopropanetetraacetic acid, 1,2-diaminopropanetetraacetic acid, nitrilotriacetic acid, nitrilotripropionic acid, triethylenetetraminehexaacetic acid, ethylenediaminedisuccinic acid, 1,3-diaminopropanedisuccinic acid, glutamic acid-N,N-diacetic acid, aspartic acid-N,N-diacetic acid, hydroxyethane diphosphonic acid, nitrilotrimethylene phosphonic acid, phosphonobutane triacetic acid, ethylenediaminetetramethylene phosphonic acid, diethylenetriaminepentamethylene phosphonic acid, hexamethylenediaminetetramethylene phosphonic acid, phosphono hydroxyacetic acid, hydroxyethyldimethylene phosphonic acid, aminotri(methylene phosphonic acid), and 2-phosphonobutane-1,2,4-tricarboxylic acid. These chelating agents may also be used as alkali salts such as a sodium salt, a potassium salt and the like, amine salts, and ammonium salts. It should be noted that, of these compounds, ethylenediaminetetraacetic acid, diethylenetriaminepentaacetatic acid, triethylenetetraminehexaacetic acid, nitrilotriacetatic acid are particularly preferred.

Examples of the viscosity index improving agent include poly(C1 to 18) alkylmethacrylate, a (C1 to 18) alkylacrylate/(C1 to 18)alkylmethacrylate copolymer, a diethylaminoethylmethacrylate/(C1 to 18) alkylmethacrylate copolymer, an ethylene/(C1 to 18)alkylmethacrylate copolymer, polyisobutylene, polyalkylstyrene, an ethylene/propylene copolymer, a styrene/maleic acid ester copolymer, and a styrene/isoprene hydrogenated copolymer. Further, a dispersion type or multifunctional type viscosity index improving agent with a dispersing function may be used. It should be noted that, the viscosity index improving agent has a weight average molecular weight of approximately 10,000 to 1,500,000.

Examples of extreme pressure agents include monobutyl phosphate, monooctyl phosphate, monolauryl phosphate, dibutyl phosphate, dioctyl phosphate, dilauryl phosphate, tributyl phosphate, trioctyl phosphate, trilauryl phosphate, triphenyl phosphate, monobutyl phosphite, monooctyl phosphite, monolauryl phosphite, dibutylphosphite, dioctyl phosphite, dilauryl phosphite, tributyl phosphite, trioctyl phosphite, trilauryl phosphite, triphenyl phosphite, monobutylthio phosphate, monooctyl thiophosphate, monolauryl thiophosphate, dibutyl thiophosphate, dioctyl thiophosphate, dilauryl thiophosphate, tributyl thiophosphate, trioctyl thiophosphate, triphenyl thiophosphate, trilauryl thiophosphate, monobutyl thiophosphite, monooctyl thiophosphite, monolauryl thiophosphite, dibutyl thiophosphite, dioctyl thiophosphite, dilauryl thiophosphite, tributyl thiophosphite, trioctyl thiophosphite, triphenyl thiophosphite, trilauryl thiophosphite, and salts thereof.

Examples of defoaming agents include fat-and-oil-based defoaming agents such as castor oil, sesame oil, linseed oil, and animal and plant oils; aliphatic acid-based defoaming agents such as stearic acid, oleic acid, and palmitic acid; fatty acid ester-based defoaming agents such as isoamyl stearate, distearyl succinate, ethylene glycol distearate, sorbitan monolaurate, polyoxyethylene sorbitan monolaurate, butylstearate, natural wax, and monoglyceride; alcohol-based defoaming agents such as polyoxyalkylene glycol and derivatives thereof, polyoxyalkylene monohydric alcohol, di-t-amylphenoxyethanol, and 3-heptanol, 2-ethylhexanol; ether-based defoaming agents such as di-t-aminophenoxyethanol, 3-heptylcellusolve, 3-heptylcellosolve, and 3-heptylcarbitol; phosphoric acid ester-based defoaming agents such as tributyl phosphate, sodium octyl phosphate, and tris(butoxyethyl) phosphate; amine-based defoaming agents such as diamylamine; amide-based defoaming agents such as polyalkylamide, acylatepolyamine, and dioctadecanoylpiperazine; metal soap-based defoaming agents such as aluminium stearate, calcium stearate, potassium oleate, and calcium salts of wool oleic acid; sulfate-based defoaming agents such as sodium lauryl sulfate; silicone-based defoaming agents such as dimethylpolysiloxane, silicone paste, silicone emulsion, silicone-processed powder, organic modified polysiloxane, and fluorine silicone; and ferric sulfate, bauxite, trichloride trifluoronated propane.

Examples of the colorants include inorganic pigments such as titanium oxide, barium sulfate, calcium carbonate, ultramarine, Prussian blue, red iron oxide, zinc white, and magnetic iron oxide; organic pigments such as lake pigments, azo pigments, isoindolin-based pigments, phthalocyanine-based pigments, quinacridone-based pigments, and anthraquinone-based pigments; carbon black; and dyes. One of these kinds may be used alone or two or more of these kinds thereof may be used in combination.

It should be noted that the blending amount of each of the other additives mentioned above is in a range of 0.0001 to 10 mass % and preferably in a range of 0.005 to 1 mass % with respect to the total mass of the functional fluid.

The functional fluid of the present invention can be suitably used as a brake fluid, an operating fluid, an engine coolant fluid, a transmission fluid, a lubricant, and a fluid for metal working.

EXAMPLES

Hereinafter, the functional fluid of the present invention will be described in more detail by way of examples, but the present invention is not limited to the examples below.

Example

Functional fluids of the present invention were each prepared by adding, to one of basic blends (1) to (4) below, a tetrazole compound (A) or a tetrazole compound (A) and a triazole compound (C) in a blending amount shown in Tables 1 to 8 below. It should be noted that "remainder" in each basic blend refers to a value that makes the total mass of the functional fluid 100 mass % after the tetrazole compound (A) or the tetrazole compound (A) and the triazole compound (C) were added.

| | Blending amount |
|---|---|
| Basic blend (1) | |
| Triethylene glycol monomethyl ether | remainder |

| | Blending amount (mass %) |
|---|---|
| Basic blend (2) | |
| Dicyclohexylamine | 0.5 |
| Ethylenediaminetetraacetic acid | 0.001 |
| 4,4-butylidenebis(6-tert-butyl-m-cresol) | 0.2 |
| Triethylene glycol monomethyl ether | remainder |
| Basic blend (3) | |
| Dicyclohexylamine | 0.5 |
| Dibutylamine | 0.1 |
| Diethylenetriaminepentaacetic acid | 0.001 |
| 4,4-butylidenebis(6-tert-butyl-m-cresol) | 0.2 |
| Triethylene glycol monomethyl ether | remainder |
| Basic blend (4) | |
| Diethylene glycol monomethyl ether | 20.0 |
| Di-2-ethylhexylamine | 0.5 |
| Triethylenetetraminehexaacetic acid | 0.001 |

-continued

| | |
|---|---|
| 2,6-di-tert-butyl-p-cresol | 0.2 |
| Triethylene glycol monomethyl ether | remainder |

Comparative Example

For comparison, comparative products were each prepared by adding, to one of the basic blends (1) to (4) above, one of the compounds in a blending amount shown in Tables 9 to 16.

100 ml of each of the functional fluids, which were the obtained as products of the present invention and comparative products, were charged into a glass bottle, and then a rubber material (styrene-butadiene rubber, about 2.6 g) and tough pitch copper (99.90 mass % or more of copper, about 16 g) were added thereto. The lid was then closed to seal the bottle, and next, the mixture was heated at 100° C. for 120 hours. After completing the heating, the eluted amount of copper (ppm) and the amount of generated sediment (vol %) in the sample were measured. It should be noted that the eluted amount of copper was measured by an atomic absorption method. Further, the amount of sediment was measured by separating the generated sediment by centrifugation. The obtained results are included in Tables 1 to 16.

TABLE 1

Single use of tetrazole compound (A), addition to basic blend (1)

| | Example | Name of tetrazole compound | Addition amount (mass %) | Property evaluation: Eluted amount of copper (ppm) | Property evaluation: Amount of sediment (vol %) |
|---|---|---|---|---|---|
| Inventive Product | (1)-1 | 1H-tetrazole | 0.01 | 10 | 0.4 |
| | (1)-2 | 1H-tetrazole | 0.1 | 40 | 0.5 |
| | (1)-3 | 5-methyl-1H-tetrazole | 0.01 | 10 | 0.4 |
| | (1)-4 | 5-methyl-1H-tetrazole | 0.1 | 40 | 0.5 |
| | (1)-5 | 5-amino-1H-tetrazole | 0.01 | 10 | 0.4 |
| | (1)-6 | 5-amino-1H-tetrazole | 0.1 | 40 | 0.5 |
| | (1)-7 | 5-phenyl-1H-tetrazole | 0.01 | 10 | 0.4 |
| | (1)-8 | 5-phenyl-1H-tetrazole | 0.1 | 40 | 0.5 |
| | (1)-9 | 5,5'-azobis-1H-tetrazole | 0.01 | 10 | 0.4 |
| | (1)-10 | 5,5'-azobis-1H-tetrazole | 0.1 | 40 | 0.5 |

TABLE 2

Single use of tetrazole compound (A), addition to basic blend (2)

| | Example | Name of tetrazole compound | Addition amount (mass %) | Property evaluation: Eluted amount of copper (ppm) | Property evaluation: Amount of sediment (vol %) |
|---|---|---|---|---|---|
| Inventive Product | (2)-1 | 1H-tetrazole | 0.01 | 10 | 0.4 |
| | (2)-2 | 1H-tetrazole | 0.1 | 40 | 0.5 |
| | (2)-3 | 5-methyl-1H-tetrazole | 0.01 | 10 | 0.4 |
| | (2)-4 | 5-methyl-1H-tetrazole | 0.1 | 40 | 0.5 |
| | (2)-5 | 5-amino-1H-tetrazole | 0.01 | 10 | 0.4 |
| | (2)-6 | 5-amino-1H-tetrazole | 0.1 | 40 | 0.5 |
| | (2)-7 | 5-phenyl-1H-tetrazole | 0.01 | 10 | 0.4 |
| | (2)-8 | 5-phenyl-1H-tetrazole | 0.1 | 40 | 0.5 |
| | (2)-9 | 5,5'-azobis-1H-tetrazole | 0.01 | 10 | 0.4 |
| | (2)-10 | 5,5'-azobis-1H-tetrazole | 0.1 | 40 | 0.5 |

TABLE 3

| Single use of tetrazole compound (A), addition to basic blend (3) | | | | | |
|---|---|---|---|---|---|
| | | | | Property evaluation | |
| | Example | Name of tetrazole compound | Addition amount (mass %) | Eluted amount of copper (ppm) | Amount of sediment (vol %) |
| Inventive Product | (3)-1 | 1H-tetrazole | 0.01 | 10 | 0.4 |
| | (3)-2 | 1H-tetrazole | 0.1 | 40 | 0.5 |
| | (3)-3 | 5-methyl-1H-tetrazole | 0.01 | 10 | 0.4 |
| | (3)-4 | 5-methyl-1H-tetrazole | 0.1 | 40 | 0.5 |
| | (3)-5 | 5-amino-1H-tetrazole | 0.01 | 10 | 0.4 |
| | (3)-6 | 5-amino-1H-tetrazole | 0.1 | 40 | 0.5 |
| | (3)-7 | 5-phenyl-1H-tetrazole | 0.01 | 10 | 0.4 |
| | (3)-8 | 5-phenyl-1H-tetrazole | 0.1 | 40 | 0.5 |
| | (3)-9 | 5,5'-azobis-1H-tetrazole | 0.01 | 10 | 0.4 |
| | (3)-10 | 5,5'-azobis-1H-tetrazole | 0.1 | 40 | 0.5 |

TABLE 4

| Single use of tetrazole compound (A), addition to basic blend (4) | | | | | |
|---|---|---|---|---|---|
| | | | | Property evaluation | |
| | Example | Name of tetrazole compound | Addition amount (mass %) | Eluted amount of copper (ppm) | Amount of sediment (vol %) |
| Inventive Product | (4)-1 | 1H-tetrazole | 0.01 | 10 | 0.4 |
| | (4)-2 | 1H-tetrazole | 0.1 | 40 | 0.5 |
| | (4)-3 | 5-methyl-1H-tetrazole | 0.01 | 10 | 0.4 |
| | (4)-4 | 5-methyl-1H-tetrazole | 0.1 | 40 | 0.5 |
| | (4)-5 | 5-amino-1H-tetrazole | 0.01 | 10 | 0.4 |
| | (4)-6 | 5-amino-1H-tetrazole | 0.1 | 40 | 0.5 |
| | (4)-7 | 5-phenyl-1H-tetrazole | 0.01 | 10 | 0.4 |
| | (4)-8 | 5-phenyl-1H-tetrazole | 0.1 | 40 | 0.5 |
| | (4)-9 | 5,5'-azobis-1H-tetrazole | 0.01 | 10 | 0.4 |
| | (4)-10 | 5,5'-azobis-1H-tetrazole | 0.1 | 40 | 0.5 |

TABLE 5

| Combined use of tetrazole compound (A) and triazole compound (C), addition to basic blend (1) | | | | | | | |
|---|---|---|---|---|---|---|---|
| | | | | | | Property evaluation | |
| | Example | Name of tetrazole compound | Addition amount (mass %) | Name of triazole compound | Addition amount (mass %) | Eluted amount of copper (ppm) | Amount of sediment (vol %) |
| Inventive Product | (1)-11 | 1H-tetrazole | 0.01 | Benzotriazole | 0.01 | 5 | 0 |
| | (1)-12 | 5-methyl-1H-tetrazole | 0.01 | Tolyltriazole | 0.1 | 5 | 0 |
| | (1)-13 | 5-amino-1H-tetrazole | 0.1 | Carboxybenzo-triazole | 0.01 | 5 | 0 |
| | (1)-14 | 5-phenyl-1H-tetrazole | 0.1 | 3-amino-1,2,4-triazole | 0.1 | 5 | 0 |
| | (1)-15 | 5,5'-azobis-1H-tetrazole | 0.01 | 1H-1,2,4-triazole | 0.01 | 5 | 0 |
| | (1)-16 | 1H-tetrazole | 0.01 | Cyclohexano[1,2-d]triazole | 0.1 | 5 | 0 |
| | (1)-17 | 5-methyl-1H-tetrazole | 0.1 | 1-[N,N-bis(2-ethylhexyl)aminomethyl]benzotriazole | 0.01 | 5 | 0 |
| | (1)-18 | 5-amino-1H-tetrazole | 0.1 | 1-[N,N-bis(2-ethylhexyl)aminomethyl]tolyltriazole | 0.1 | 5 | 0 |

TABLE 5-continued

| Combined use of tetrazole compound (A) and triazole compound (C), addition to basic blend (1) | | | | | | | |
|---|---|---|---|---|---|---|---|
| | | | | | | Property evaluation | |
| | Example | Name of tetrazole compound | Addition amount (mass %) | Name of triazole compound | Addition amount (mass %) | Eluted amount of copper (ppm) | Amount of sediment (vol %) |
| | (1)-19 | 5-phenyl-1H-tetrazole | 0.01 | 1-[N,N-bis(2-ethylhexyl)aminomethyl]carboxybenzo triazole | 0.01 | 5 | 0 |
| | (1)-20 | 5,5'-azobis-1H-tetrazole | 0.01 | 5-amino-1,2,4-triazole-3-carboxylic acid | 0.1 | 5 | 0 |
| | (1)-21 | 1H-tetrazole | 0.1 | 1-(1',2'-di-carboxyethyl)benzotriazole | 0.01 | 5 | 0 |
| | (1)-22 | 5-methyl-1H-tetrazole | 0.1 | 1,2,4-triazole-3-ol | 0.1 | 5 | 0 |
| | (1)-23 | 5-amino-1H-tetrazole | 0.01 | 1,2,4-triazole-3-carboxyamide | 0.01 | 5 | 0 |
| | (1)-24 | 5-phenyl-1H-tetrazole | 0.01 | 4-aminourazole | 0.1 | 5 | 0 |
| | (1)-25 | 5,5'-azobis-1H-tetrazole | 0.1 | 1,2,4-triazole-5-one | 0.01 | 5 | 0 |

TABLE 6

| Combined use of tetrazole compound (A) and triazole compound (C), addition to basic blend (2) | | | | | | | |
|---|---|---|---|---|---|---|---|
| | | | | | | Property evaluation | |
| | Example | Name of tetrazole compound | Addition amount (mass %) | Name of triazole compound | Addition amount (mass %) | Eluted amount of copper (ppm) | Amount of sediment (vol %) |
| Inventive Product | (2)-11 | 1H-tetrazole | 0.01 | Benzotriazole | 0.01 | 5 | 0 |
| | (2)-12 | 5-methyl-1H-tetrazole | 0.01 | Tolyltriazole | 0.1 | 5 | 0 |
| | (2)-13 | 5-amino-1H-tetrazole | 0.1 | Carboxybenzo-triazole | 0.01 | 5 | 0 |
| | (2)-14 | 5-phenyl-1H-tetrazole | 0.1 | 3-amino-1,2,4-triazole | 0.1 | 5 | 0 |
| | (2)-15 | 5,5'-azobis-1H-tetrazole | 0.01 | 1H-1,2,4-triazole | 0.01 | 5 | 0 |
| | (2)-16 | 1H-tetrazole | 0.01 | Cyclohexano[1,2-d]triazole | 0.1 | 5 | 0 |
| | (2)-17 | 5-methyl-1H-tetrazole | 0.1 | 1-[N,N-bis(2-ethylhexyl)aminomethyl]benzotriazole | 0.01 | 5 | 0 |
| | (2)-18 | 5-amino-1H-tetrazole | 0.1 | 1-[N,N-bis(2-ethylhexyl)aminomethyl]tolyltriazole | 0.1 | 5 | 0 |
| | (2)-19 | 5-phenyl-1H-tetrazole | 0.01 | 1-[N,N-bis(2-ethylhexyl)aminomethyl]carboxybenzo triazole | 0.01 | 5 | 0 |
| | (2)-20 | 5,5'-azobis-1H-tetrazole | 0.01 | 5-amino-1,2,4-triazole-3-carboxylic acid | 0.1 | 5 | 0 |
| | (2)-21 | 1H-tetrazole | 0.1 | 1-(1',2'-di-carboxyethyl)benzotriazole | 0.01 | 5 | 0 |
| | (2)-22 | 5-methyl-1H-tetrazole | 0.1 | 1,2,4-triazole-3-ol | 0.1 | 5 | 0 |
| | (2)-23 | 5-amino-1H-tetrazole | 0.01 | 1,2,4-triazole-3-carboxyamide | 0.01 | 5 | 0 |
| | (2)-24 | 5-phenyl-1H-tetrazole | 0.01 | 4-aminourazole | 0.1 | 5 | 0 |
| | (2)-25 | 5,5'-azobis-1H-tetrazole | 0.1 | 1,2,4-triazole-5-one | 0.01 | 5 | 0 |

TABLE 7

Combined use of tetrazole compound (A) and triazole compound (C), addition to basic blend (3)

| | Example | Name of tetrazole compound | Addition amount (mass %) | Name of triazole compound | Addition amount (mass %) | Property evaluation: Eluted amount of copper (ppm) | Property evaluation: Amount of sediment (vol %) |
|---|---|---|---|---|---|---|---|
| Inventive Product | (3)-11 | 1H-tetrazole | 0.01 | Benzotriazole | 0.01 | 5 | 0 |
| | (3)-12 | 5-methyl-1H-tetrazole | 0.01 | Tolyltriazole | 0.1 | 5 | 0 |
| | (3)-13 | 5-amino-1H-tetrazole | 0.1 | Carboxybenzo triazole | 0.01 | 5 | 0 |
| | (3)-14 | 5-phenyl-1H-tetrazole | 0.1 | 3-amino-1,2,4-triazole | 0.1 | 5 | 0 |
| | (3)-15 | 5,5'-azobis-1H-tetrazole | 0.01 | 1H-1,2,4-triazole | 0.01 | 5 | 0 |
| | (3)-16 | 1H-tetrazole | 0.01 | Cyclohexano[1,2-d]triazole | 0.1 | 5 | 0 |
| | (3)-17 | 5-methyl-1H-tetrazole | 0.1 | 1-[N,N-bis(2-ethylhexyl)aminomethyl]benzotriazole | 0.01 | 5 | 0 |
| | (3)-18 | 5-amino-1H-tetrazole | 0.1 | 1-[N,N-bis(2-ethylhexyl)aminomethyl]tolyltriazole | 0.1 | 5 | 0 |
| | (3)-19 | 5-phenyl-1H-tetrazole | 0.01 | 1-[N,N-bis(2-ethylhexyl)aminomethyl]carboxybenzo triazole | 0.01 | 5 | 0 |
| | (3)-20 | 5,5'-azobis-1H-tetrazole | 0.01 | 5-amino-1,2,4-triazole-3-carboxylic acid | 0.1 | 5 | 0 |
| | (3)-21 | 1H-tetrazole | 0.1 | 1-(1',2'-di-carboxyethyl)benzotriazole | 0.01 | 5 | 0 |
| | (3)-22 | 5-methyl-1H-tetrazole | 0.1 | 1,2,4-triazole-3-ol | 0.1 | 5 | 0 |
| | (3)-23 | 5-amino-1H-tetrazole | 0.01 | 1,2,4-triazole-3-carboxyamide | 0.01 | 5 | 0 |
| | (3)-24 | 5-phenyl-1H-tetrazole | 0.01 | 4-aminourazole | 0.1 | 5 | 0 |
| | (3)-25 | 5,5'-azobis-1H-tetrazole | 0.1 | 1,2,4-triazole-5-one | 0.01 | 5 | 0 |

TABLE 8

Combined use of tetrazole compound (A) and triazole compound (C), addition to basic blend (4)

| | Example | Name of tetrazole compound | Addition amount (mass %) | Name of triazole compound | Addition amount (mass %) | Property evaluation: Eluted amount of copper (ppm) | Property evaluation: Amount of sediment (vol %) |
|---|---|---|---|---|---|---|---|
| Inventive Product | (4)-11 | 1H-tetrazole | 0.01 | Benzotriazole | 0.01 | 5 | 0 |
| | (4)-12 | 5-methyl-1H-tetrazole | 0.01 | Tolyltriazole | 0.1 | 5 | 0 |
| | (4)-13 | 5-amino-1H-tetrazole | 0.1 | Carboxybenzotriazole | 0.01 | 5 | 0 |
| | (4)-14 | 5-phenyl-1H-tetrazole | 0.1 | 3-amino-1,2,4-triazole | 0.1 | 5 | 0 |
| | (4)-15 | 5,5'-azobis-1H-tetrazole | 0.01 | 1H-1,2,4-triazole | 0.01 | 5 | 0 |
| | (4)-16 | 1H-tetrazole | 0.01 | Cyclohexano[1,2-d]triazole | 0.1 | 5 | 0 |
| | (4)-17 | 5-methyl-1H-tetrazole | 0.1 | 1-[N,N-bis(2-ethylhexyl)aminomethyl]benzotriazole | 0.01 | 5 | 0 |
| | (4)-18 | 5-amino-1H-tetrazole | 0.1 | 1-[N,N-bis(2-ethylhexyl)aminomethyl]tolyltriazole | 0.1 | 5 | 0 |
| | (4)-19 | 5-phenyl-1H-tetrazole | 0.01 | 1-[N,N-bis(2-ethylhexyl)aminomethyl]carboxybenzo triazole | 0.01 | 5 | 0 |
| | (4)-20 | 5,5'-azobis-1H-tetrazole | 0.01 | 5-amino-1,2,4-triazole-3-carboxylic acid | 0.1 | 5 | 0 |
| | (4)-21 | 1H-tetrazole | 0.1 | 1-(1',2'-di-carboxyethyl)benzotriazole | 0.01 | 5 | 0 |

TABLE 8-continued

| Combined use of tetrazole compound (A) and triazole compound (C), addition to basic blend (4) | | | | | | |
|---|---|---|---|---|---|---|
| | | | | | Property evaluation | |
| Example | Name of tetrazole compound | Addition amount (mass %) | Name of triazole compound | Addition amount (mass %) | Eluted amount of copper (ppm) | Amount of sediment (vol %) |
| (4)-22 | 5-methyl-1H-tetrazole | 0.1 | 1,2,4-triazole-3-ol | 0.1 | 5 | 0 |
| (4)-23 | 5-amino-1H-tetrazole | 0.01 | 1,2,4-triazole-3-carboxyamide | 0.01 | 5 | 0 |
| (4)-24 | 5-phenyl-1H-tetrazole | 0.01 | 4-aminourazole | 0.1 | 5 | 0 |
| (4)-25 | 5,5'-azobis-1H-tetrazole | 0.1 | 1,2,4-triazole-5-one | 0.01 | 5 | 0 |

TABLE 9

| Addition to basic blend (1) | | | | | |
|---|---|---|---|---|---|
| | | | | Property evaluation | |
| | Comparative example | Name of tetrazole compound | Addition amount (mass %) | Eluted amount of copper (ppm) | Amount of sediment (vol %) |
| Comparative product | (1)-1 | Not added | — | 800 | 4.0 |
| | (1)-2 | 1H-1,2,4-triazole | 0.1 | 400 | 4.0 |
| | (1)-3 | 1H-tetrazole | 0.001 | 700 | 4.0 |
| | (1)-4 | 1H-tetrazole | 1 | 600 | 4.0 |
| | (1)-5 | 5-methyl-1H-tetrazole | 0.001 | 800 | 4.0 |
| | (1)-6 | 5-methyl-1H-tetrazole | 1 | 600 | 4.0 |
| | (1)-7 | 5-amino-1H-tetrazole | 0.001 | 800 | 4.0 |
| | (1)-8 | 5-amino-1H-tetrazole | 1 | 600 | 4.0 |
| | (1)-9 | 5-phenyl-1H-tetrazole | 0.001 | 800 | 4.0 |
| | (1)-10 | 5-phenyl-1H-tetrazole | 1 | 600 | 4.0 |
| | (1)-11 | 5,5'-azobis-1H-tetrazole | 0.001 | 800 | 4.0 |
| | (1)-12 | 5,5'-azobis-1H-tetrazole | 1 | 600 | 4.0 |

TABLE 10

| Addition to basic blend (2) | | | | | |
|---|---|---|---|---|---|
| | | | | Property evaluation | |
| | Comparative example | Name of tetrazole compound | Addition amount (mass %) | Eluted amount of copper (ppm) | Amount of sediment (vol %) |
| Comparative product | (2)-1 | Not added | — | 800 | 4.0 |
| | (2)-2 | 1H-1,2,4-triazole | 0.1 | 400 | 4.0 |
| | (2)-3 | 1H-tetrazole | 0.001 | 700 | 4.0 |
| | (2)-4 | 1H-tetrazole | 1 | 600 | 4.0 |
| | (2)-5 | 5-methyl-1H-tetrazole | 0.001 | 800 | 4.0 |
| | (2)-6 | 5-methyl-1H-tetrazole | 1 | 600 | 4.0 |
| | (2)-7 | 5-amino-1H-tetrazole | 0.001 | 800 | 4.0 |
| | (2)-8 | 5-amino-1H-tetrazole | 1 | 600 | 4.0 |
| | (2)-9 | 5-phenyl-1H-tetrazole | 0.001 | 800 | 4.0 |
| | (2)-10 | 5-phenyl-1H-tetrazole | 1 | 600 | 4.0 |
| | (2)-11 | 5,5'-azobis-1H-tetrazole | 0.001 | 800 | 4.0 |
| | (2)-12 | 5,5'-azobis-1H-tetrazole | 1 | 600 | 4.0 |

TABLE 11

| Addition to basic blend (3) | | | | | |
|---|---|---|---|---|---|
| | | | | Property evaluation | |
| | Comparative example | Name of tetrazole compound | Addition amount (mass %) | Eluted amount of copper (ppm) | Amount of sediment (vol %) |
| Comparative product | (3)-1 | Not added | — | 800 | 4.0 |
| | (3)-2 | 1H-1,2,4-triazole | 0.1 | 400 | 4.0 |
| | (3)-3 | 1H-tetrazole | 0.001 | 700 | 4.0 |
| | (3)-4 | 1H-tetrazole | 1 | 600 | 4.0 |
| | (3)-5 | 5-methyl-1H-tetrazole | 0.001 | 800 | 4.0 |
| | (3)-6 | 5-methyl-1H-tetrazole | 1 | 600 | 4.0 |
| | (3)-7 | 5-amino-1H-tetrazole | 0.001 | 800 | 4.0 |
| | (3)-8 | 5-amino-1H-tetrazole | 1 | 600 | 4.0 |
| | (3)-9 | 5-phenyl-1H-tetrazole | 0.001 | 800 | 4.0 |
| | (3)-10 | 5-phenyl-1H-tetrazole | 1 | 600 | 4.0 |
| | (3)-11 | 5,5'-azobis-1H-tetrazole | 0.001 | 800 | 4.0 |
| | (3)-12 | 5,5'-azobis-1H-tetrazole | 1 | 600 | 4.0 |

TABLE 12

| Addition to basic blend (4) | | | | | |
|---|---|---|---|---|---|
| | | | | Property evaluation | |
| | Comparative example | Name of tetrazole compound | Addition amount (mass %) | Eluted amount of copper (ppm) | Amount of sediment (vol %) |
| Comparative product | (4)-1 | Not added | — | 800 | 4.0 |
| | (4)-2 | 1H-1,2,4-triazole | 0.1 | 400 | 4.0 |
| | (4)-3 | 1H-tetrazole | 0.001 | 700 | 4.0 |
| | (4)-4 | 1H-tetrazole | 1 | 600 | 4.0 |
| | (4)-5 | 5-methyl-1H-tetrazole | 0.001 | 800 | 4.0 |
| | (4)-6 | 5-methyl-1H-tetrazole | 1 | 600 | 4.0 |
| | (4)-7 | 5-amino-1H-tetrazole | 0.001 | 800 | 4.0 |
| | (4)-8 | 5-amino-1H-tetrazole | 1 | 600 | 4.0 |
| | (4)-9 | 5-phenyl-1H-tetrazole | 0.001 | 800 | 4.0 |
| | (4)-10 | 5-phenyl-1H-tetrazole | 1 | 600 | 4.0 |
| | (4)-11 | 5,5'-azobis-1H-tetrazole | 0.001 | 800 | 4.0 |
| | (4)-12 | 5,5'-azobis-1H-tetrazole | 1 | 600 | 4.0 |

TABLE 13

| Combined use of tetrazole compound (A) and triazole compound (C), addition to basic blend (1) | | | | | | | |
|---|---|---|---|---|---|---|---|
| | | | | | | Property evaluation | |
| | Comparative example | Name of tetrazole compound | Addition amount (mass %) | Name of triazole compound | Addition amount (mass %) | Eluted amount of copper (ppm) | Amount of sediment (vol %) |
| Comparative product | (1)-13 | 1H-tetrazole | 0.001 | Benzotriazole | 0.001 | 800 | 5.0 |
| | (1)-14 | 1H-tetrazole | 0.001 | Benzotriazole | 0.01 | 700 | 4.0 |
| | (1)-15 | 1H-tetrazole | 0.001 | Benzotriazole | 1 | 600 | 4.0 |
| | (1)-16 | 1H-tetrazole | 1 | Benzotriazole | 0.001 | 600 | 4.0 |
| | (1)-17 | 1H-tetrazole | 1 | Benzotriazole | 0.01 | 600 | 4.0 |
| | (1)-18 | 1H-tetrazole | 1 | Benzotriazole | 1 | 600 | 4.0 |

TABLE 14

| Combined use of tetrazole compound (A) and triazole compound (C), addition to basic blend (2) | | | | | | | |
|---|---|---|---|---|---|---|---|
| | | | | | | Property evaluation | |
| | Comparative example | Name of tetrazole compound | Addition amount (mass %) | Name of triazole compound | Addition amount (mass %) | Eluted amount of copper (ppm) | Amount of sediment (vol %) |
| Comparative product | (2)-13 | 1H-tetrazole | 0.001 | Benzotriazole | 0.001 | 800 | 5.0 |
| | (2)-14 | 1H-tetrazole | 0.001 | Benzotriazole | 0.01 | 700 | 4.0 |
| | (2)-15 | 1H-tetrazole | 0.001 | Benzotriazole | 1 | 600 | 4.0 |
| | (2)-16 | 1H-tetrazole | 1 | Benzotriazole | 0.001 | 600 | 4.0 |
| | (2)-17 | 1H-tetrazole | 1 | Benzotriazole | 0.01 | 600 | 4.0 |
| | (2)-18 | 1H-tetrazole | 1 | Benzotriazole | 1 | 600 | 4.0 |

TABLE 15

| Combined use of tetrazole compound (A) and triazole compound (C), addition to basic blend (3) | | | | | | | |
|---|---|---|---|---|---|---|---|
| | | | | | | Property evaluation | |
| | Comparative example | Name of tetrazole compound | Addition amount (mass %) | Name of triazole compound | Addition amount (mass %) | Eluted amount of copper (ppm) | Amount of sediment (vol %) |
| Comparative product | (3)-13 | 1H-tetrazole | 0.001 | Benzotriazole | 0.001 | 800 | 5.0 |
| | (3)-14 | 1H-tetrazole | 0.001 | Benzotriazole | 0.01 | 700 | 4.0 |
| | (3)-15 | 1H-tetrazole | 0.001 | Benzotriazole | 1 | 600 | 4.0 |
| | (3)-16 | 1H-tetrazole | 1 | Benzotriazole | 0.001 | 600 | 4.0 |
| | (3)-17 | 1H-tetrazole | 1 | Benzotriazole | 0.01 | 600 | 4.0 |
| | (3)-18 | 1H-tetrazole | 1 | Benzotriazole | 1 | 600 | 4.0 |

TABLE 16

| Combined use of tetrazole compound (A) and triazole compound (C), addition to basic blend (4) | | | | | | | |
|---|---|---|---|---|---|---|---|
| | | | | | | Property evaluation | |
| | Comparative example | Name of tetrazole compound | Addition amount (mass %) | Name of triazole compound | Addition amount (mass %) | Eluted amount of copper (ppm) | Amount of sediment (vol %) |
| Comparative product | (4)-13 | 1H-tetrazole | 0.001 | Benzotriazole | 0.001 | 800 | 5.0 |
| | (4)-14 | 1H-tetrazole | 0.001 | Benzotriazole | 0.01 | 700 | 4.0 |
| | (4)-15 | 1H-tetrazole | 0.001 | Benzotriazole | 1 | 600 | 4.0 |
| | (4)-16 | 1H-tetrazole | 1 | Benzotriazole | 0.001 | 600 | 4.0 |
| | (4)-17 | 1H-tetrazole | 1 | Benzotriazole | 0.01 | 600 | 4.0 |
| | (4)-18 | 1H-tetrazole | 1 | Benzotriazole | 1 | 600 | 4.0 |

The invention claimed is:

1. A brake fluid consisting essentially of:

a tetrazole compound (A) contained in an amount of 0.005 mass % to 0.5 mass % with respect to a total mass of the brake fluid, which is selected from the group consisting of 1H-tetrazole, 5-amino-1H-tetrazole, 5-methyl-1H-tetrazole, 1-methyl-5-ethyl-1H-tetrazole, 1-methyl-5-aminotetrazole, 1-methyl-5-mercapto-1H-tetrazole, 1-phenyl-5-mercapto-1H-tetrazole, 1-(2-dimethylaminoethyl)-5-mercapto-1H-tetrazole, 5-phenyl-1H-tetrazole, 5,5'-bis-1H-tetrazole diammonium salt, 4,5-di(5-tetrazolyl)-[1,2,3]triazole, and 5,5'-azobis-1H-tetrazole;

a base oil (B) selected from glycols, polymeric derivatives thereof, mixtures thereof, glycol ethers, borate esters, phosphate esters and mixtures of glycols with glycol ethers and/or borate esters or phosphate esters;

a triazole compound (C) contained in an amount of 0.005 mass % to 0.5 mass % with respect to a total mass of the brake fluid; and optionally one or more other additives selected from the group consisting of amines, antioxidants, chelating agents, viscosity index improving agents, extreme pressure agents, defoaming agents, and colorants.

2. The brake fluid according to claim 1, wherein one or more other additives selected from the group consisting of amines, antioxidants, chelating agents, viscosity index improving agents, extreme pressure agents, defoaming agents, and colorants is present.

3. The brake fluid according to claim 2, wherein the other additives are contained in an amount of 0.0001 to 10 mass % with respect to a total mass of the brake fluid.

* * * * *